US005324109A

United States Patent [19]

Johari

[11] Patent Number: 5,324,109

[45] Date of Patent: Jun. 28, 1994

[54] METHOD FOR THE RAPID MIXING OF FLUIDS

[75] Inventor: Hamid Johari, Worcester, Mass.

[73] Assignee: Worcester Polytechnic Institute, Worcester, Mass.

[21] Appl. No.: 80,420

[22] Filed: Jun. 18, 1993

[51] Int. Cl.[5] ..... B01F 5/04; B01F 15/04

[52] U.S. Cl. ..... 366/151; 366/182

[58] Field of Search ..... 366/348, 151, 152, 160, 366/162, 142, 182, 143, 349, 40, 167, 173

[56] References Cited

U.S. PATENT DOCUMENTS 4,362,033 12/1982 Young ..... 366/142
4,666,669 5/1987 Mumaw ..... 366/182
4,669,889 6/1987 Tachi ..... 366/182

OTHER PUBLICATIONS

Parkinson, G., "P-U-L-S-E Combination Sounds Off," *Chemical Engineering*, pp. 28-35 (Nov. 1990).

Lovett, J . A., and Turnst, S. R., "Experiments on Axisymmetrically Pulsed Turbulent Jet Flames," Amer. Inst. of Aeronautics and Astronautics, 28:38-46 (Jan. 1990).

Bremhorst, K., and Hollis, P. G., "Velocity Field of an Axisymmetric Pulsed, Subsonic Air Jet," Amer. Inst. of Aeronautics and Astronautics, 28:2043-2049 (Dec. 1990).

Morris, G. J., et al., "Gas-Solid Flow in a Fluidically Oscillating Jet," *Journal of Fluids Eng.*, 114:362-366 (Sep. 1992).

Bremhorst, K., "Unsteady Subsonic Turbulent Jets," pp. 480-500 (1979).

Hill, W. G., Jr., et al., "Increased Turbulent Jet Mixing Rates Obtained by Self-Excited Acoustic Oscillations," *Journal of Fluids Eng.*, 99:520-525 (Sep. 1977).

*Primary Examiner*—Robert W. Jenkins

*Attorney, Agent, or Firm*—Hamilton, Brook, Smith & Reynolds

[57] ABSTRACT

A method of mixing two fluids together includes introducing a stream of first fluid through a nozzle into a volume of second fluid at an accelerating rate over a time period of at least 0.1 seconds. The acceleration of the first fluid forms a vortex of first fluid having a tail of first fluid within the volume of second fluid. The stream of first fluid is then decelerated over a time period of at least 0.1 seconds which produces rapid mixing of the second fluid in the tail of first fluid.

22 Claims, 4 Drawing Sheets

METHOD FOR THE RAPID MIXING OF FLUIDS

BACKGROUND

Many processes involving fluids, which can be liquid or gases, require that the fluids be mixed. Examples include the fuel intake process in internal combustion engines, the mixing of chemicals in the chemical processing industry and the injection of fluorine into hydrogen for pulsed HF lasers.

The mixing of fluids has been commonly performed by injecting a steady jet of one fluid through a nozzle into a volume of another fluid. However, the maximum mixing rate of fluids obtainable with a steady jet is not always fast enough for some applications. A faster method for mixing gases was developed in which a series of short pulses of one gas were injected into a volume of another gas. Each pulse of injected gas lasts only milliseconds and produces small puffs or vortices of the injected gas within the volume of the other gas. The small puffs of gas increase the surface area between the two gases, thereby, increasing the rate of mixing.

SUMMARY OF THE INVENTION

A limitation of the pulsed gas method is that the method works well with gases but not with liquids. Additionally, the mixing must be done in a closed container and large acoustical pressures are required to produce the pulses. Typically, there is a high noise level of approximately 100 dB.

Accordingly, there is a need for a quiet method of rapidly mixing both gases and liquids.

The present invention provides a method of mixing fluids which includes introducing a stream of first fluid into a volume of second fluid through a nozzle at an accelerating rate over a time period of at least 0.1 seconds. The stream of first fluid is then decelerated to about zero over a time period of at least 0.1 seconds.

In preferred embodiments, the acceleration of the stream of first fluid into the volume of second fluid forms a vortex with an ensuing turbulent jet or tail of first fluid within the second fluid. The deceleration of the stream of first fluid produces mixing of the second fluid with the tail or jet of first fluid extending from the vortex. The steps of accelerating and decelerating the stream of first fluid into the volume of second fluid can then be repeated.

The time period over which the stream of first fluid is accelerated preferably ranges approximately from ¼ second to ½ second and is approximately ⅓ the total amount of time required to accelerate and decelerate the stream of first fluid. The total amount of time required to accelerate and decelerate the stream of first fluid is less than 10 second and is preferably about 1 second. The first and second fluids can be liquids and the stream of first fluid can be accelerated into the volume of the second fluid by gravity.

The present method of mixing fluids provides rapid mixing of both gases and liquids without requiring the mixing to occur within a closed container. Furthermore, the stream of first fluid does not have to be injected by high acoustical pressures. Therefore, the mixing of the fluids is much greater than method requiring the pressurization of the injected fluid.

BRIEF DESCRIPTION OF THE DRAWING

The foregoing and other objects, features and advantages of the invention will be apparent from the following more particular description of preferred embodiments of the drawings in which like reference characters refer to the same parts throughout the different views. The drawings are not necessarily to scale, emphasis instead being placed upon illustrating the principles of the invention.

DETAILED DESCRIPTION OF THE PREFERRED EMBODIMENTS

Figure 1:
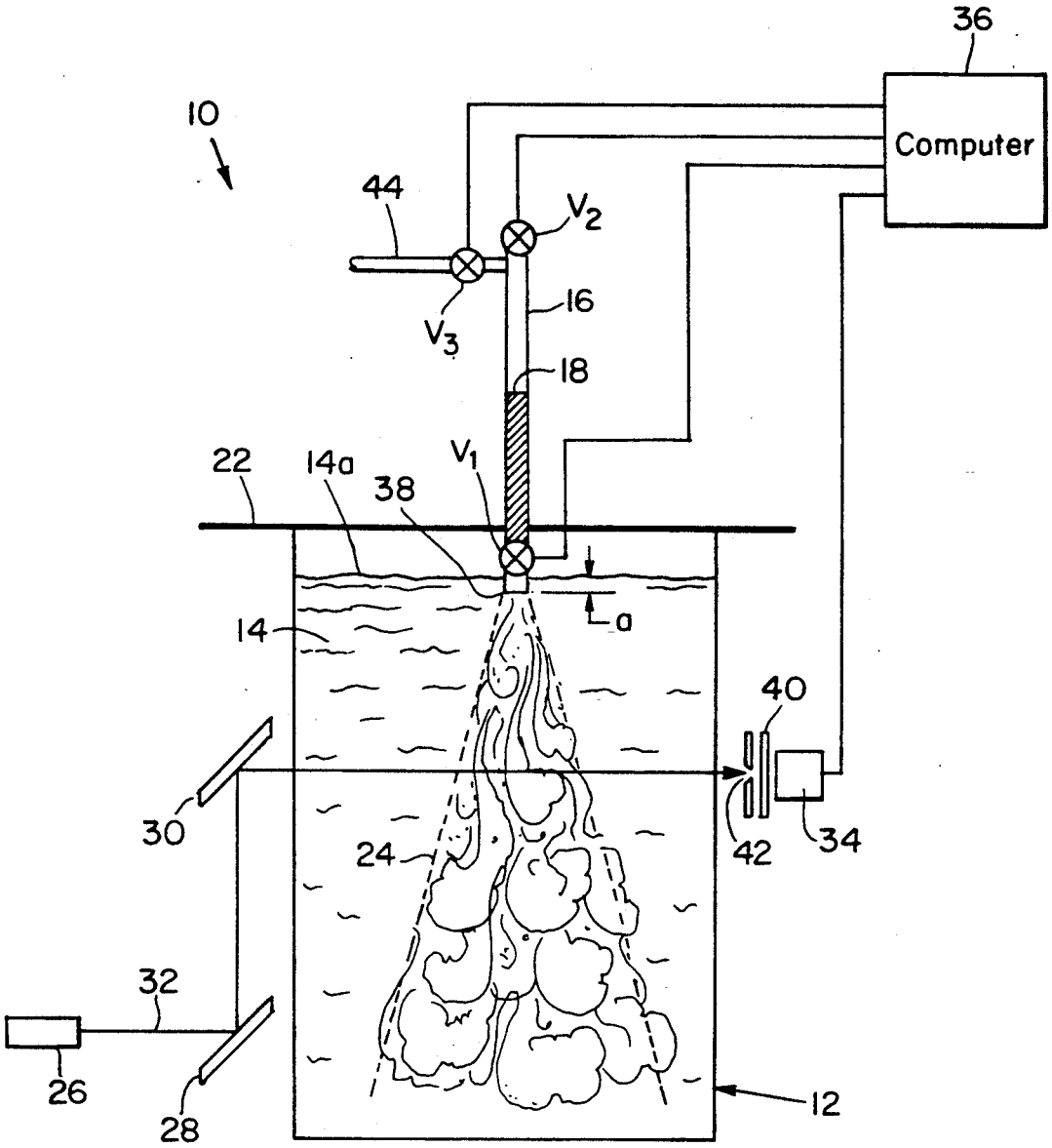
FIG. 1 is a schematic drawing of the apparatus used in injecting an unsteady stream of first fluid into a volume of second fluid.

In FIG. 1, an apparatus 10 is employed for mixing fluids 18 and 14 together by injecting an unsteady stream or jet of first fluid 18 into a volume of fluid 14. Fluid 14 is contained in a water tank 12, which for example can be 1.2 meters×1.2 meters×1.5 meters deep. A jet release mechanism 16 containing a volume of fluid 18 is mounted to a plate 22 which positions the jet release mechanism 16 above tank 12. Jet release mechanism 16 is a tube having a nozzle 38 and a solenoid operated release valve $V_1$ at the lower end and a solenoid operated venting valve $V_2$ at the upper end. Supply line 44 supplys jet release mechanism 16 with fluid 18 and is in fluid communication with jet release mechanism 16 via filling valve $V_3$. The nozzle 38 is positioned at a distance "a" below surface 14*a* which for example can be 1 centimeter. The tube can be for example, 1.22 meters long with a 2.79 centimeter inner diameter. The plate 22 and the tank 12 can be made of optically transparent material such as glass or plastics such as clear acrylic so that the mixing of fluids 18 and 14 can be detected.

Figure 3A:
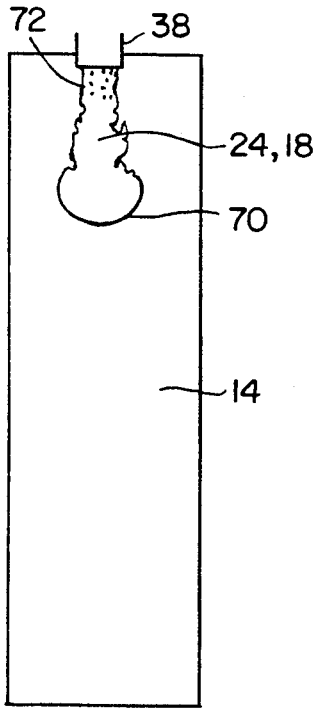
FIGS. 3*a*–3*c* depict the stream of first fluid as it is introduced into the volume of second fluid at various points in time.
Figure 3B:
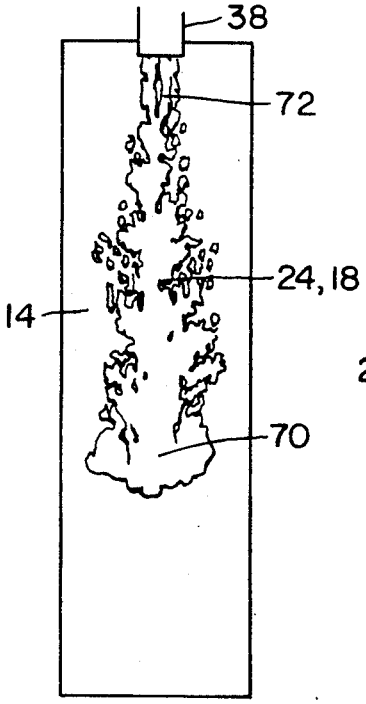
Figure 3C:
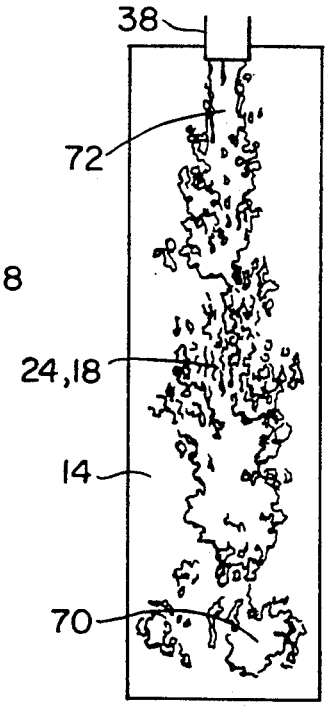

In operation, jet release mechanism 16 is filled with fluid 18 from filling line 44 by closing release valve $V_1$ and opening venting valve $V_2$ and filling valve $V_3$. Once jet release mechanism 16 is full, valves $V_3$ and $V_2$ are closed. At this time, release valve $V_1$ is opened to prepare jet release mechanism 16 for releasing fluid 18 into fluid 14. As long as venting valve $V_2$ remains closed, fluid 18 will not be released from jet release mechanism 16. When venting valve $V_2$ is opened, jet release mechanism 16 releases a turbulent stream 24 of fluid 18 through nozzle 38 into the volume of fluid 14. The stream 24 of fluid 18 is accelerated initially by gravity into fluid 14 which forms a vortex 70 of fluid 18 having a tail 72 (FIGS. 3*a*–3*c*). The stream 24 of fluid 18 then decelerates as the height of the fluid 18 within jet release mechanism 16 drops until finally terminating. The deceleration of fluid 18 following the initial acceleration rapidly draws surrounding fluid 14 into the tail 72 stream 24 which rapidly mixes the two fluids together.

Figure 2:
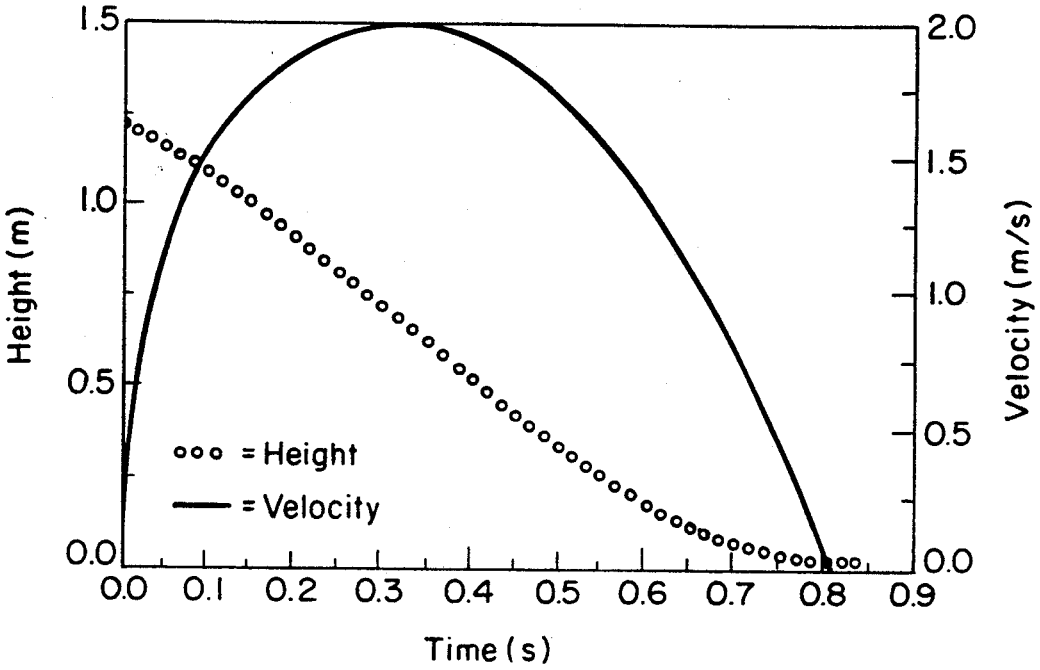
FIG. 2 is a graph depicting the relationship between fluid height versus velocity of the stream of first fluid in relation to time.

FIG. 2 depicts an example of the relationship between fluid height and the velocity of fluid 18 as a function of time. In the preferred embodiment the stream of first fluid is accelerated over a time period which is approximately ⅓ the total amount of time in which the stream of fluid 18 is accelerated and decelerated. The amount of time required to accelerate fluid 18 is at least 0.1 seconds and preferably ranges between 0.25 and 0.5 seconds. Additionally, the amount of time required to decelerate fluid 18 is at least 0.1 seconds. The total amount of time required to accelerate and decelerate fluid 18 into the volume of fluid 14 is less than 10 seconds and is preferably about 1 second.

FIGS. 3*a*–3*c* depict the stream 24 of fluid 18 as it is injected into fluid 14, on a time scale corresponding with the graph of FIG. 2. FIG. 3*a* depicts the stream 24 of fluid 18 as it is initially accelerated from nozzle 38 into fluid 14. The acceleration of fluid 18 forms a vortex 70 from which a tail 72 extends. At this point in time, almost no mixing has taken place. About 0.2 seconds has elapsed and the tip of vortex 70 is approximately 5 nozzle diameters away from nozzle 38.

Referring to FIG. 3*b*, the time elapsed is 0.5 seconds and the stream 24 of fluid 18 is undergoing deceleration. The tail 72 extending from vortex 70 has become an unsteady jet and mixing between fluid 14 and fluid 18 is beginning in tail 72. At this time, the tip vortex 70 is approximately 13 nozzle diameters away from nozzle 38.

Referring to FIG. 3*c*, the time elapsed is approximately 1 second and the tip of vortex 70 is about 18 nozzle diameters away from nozzle 38. The flow of fluid 18 has been terminated and further mixing of fluids 14 and 18 has occurred.

Figure 4:
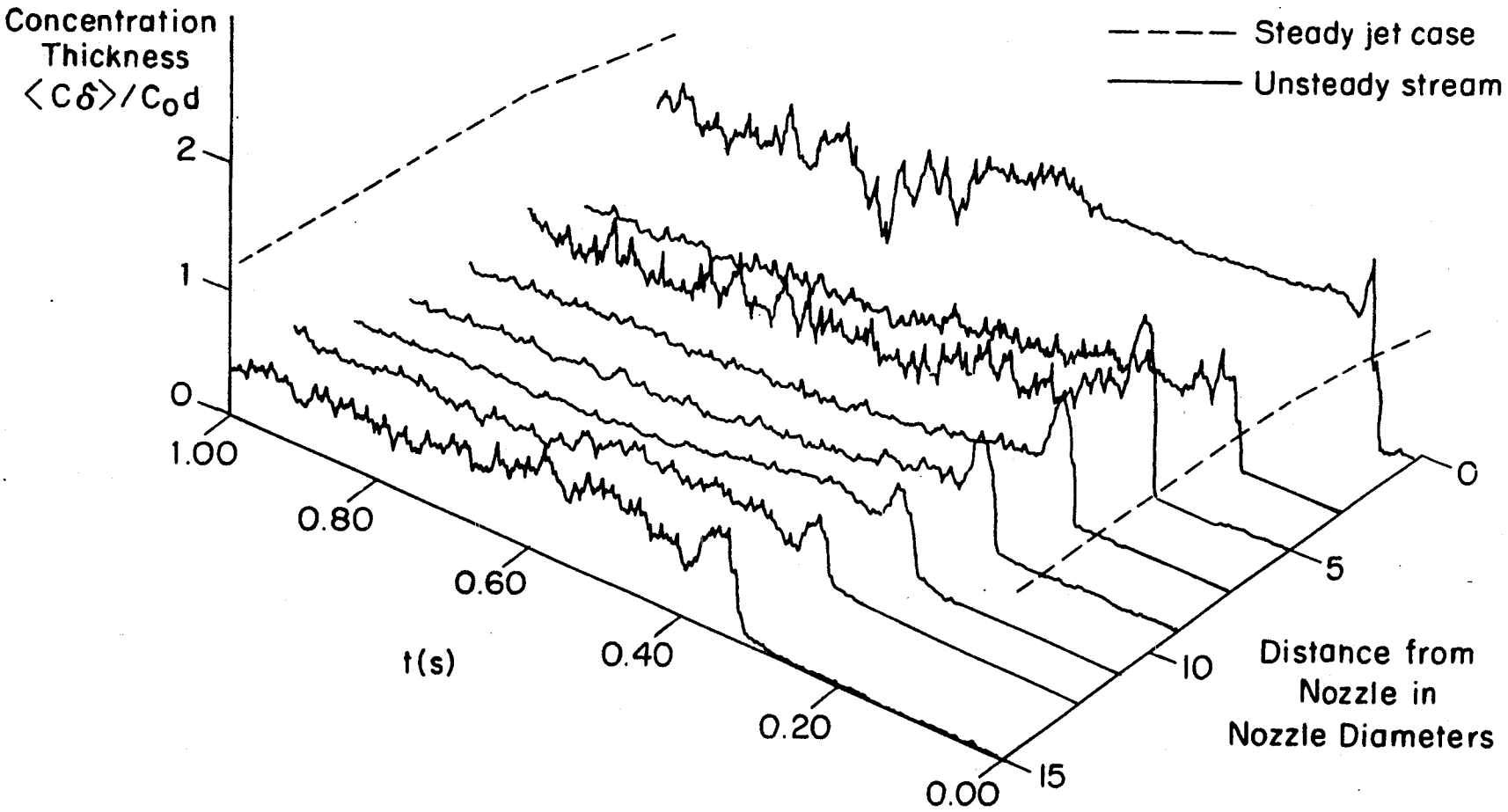
FIG. 4 is a graph showing concentration thickness of the unsteady steam of first fluid as a function of time and distance in comparison to a steady jet case.
Figure 5:
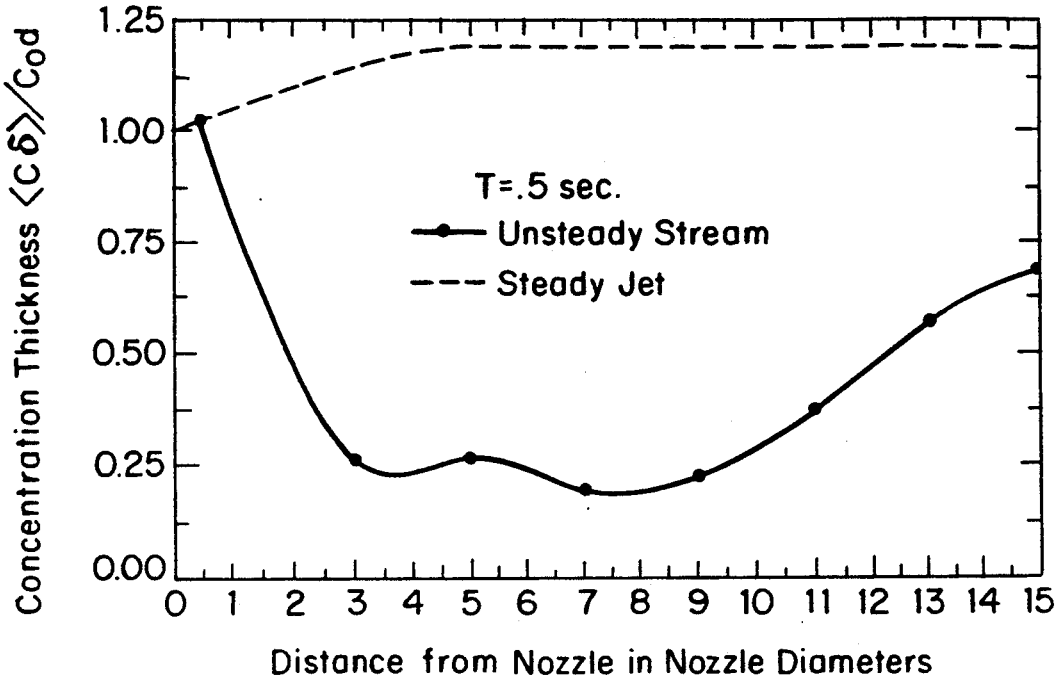
FIG. 5 is a graph comprising concentration thickness of an unsteady stream of first fluid versus a steady jet.

The degree of mixing is inversely related to the concentration thickness. Referring to FIGS. 4 and 5, it can be seen that the present invention unsteady stream of fluid 18 has a lower normalized concentration thickness $<C\delta>/C_o d$ than the concentration thickness of a steady jet at the same point in time and distance away from nozzle 38 after the passage of the starting vortex 70. The steady jet remains at a normalized concentration thickness value of about 1.2 which indicates that relatively little mixing of fluids has occurred. In contrast, the stream of fluid 18 has a concentration thickness value that is considerably below 1 only a short distance away from nozzle 38 which indicates considerable mixing of fluids 18 and 14. Equation 2 below defines $<C\delta>$ as the average concentration value integrated across the width of stream 24 of fluid 18 at any axial distance from nozzle 38 at any point in time, where $\delta$ is the local jet diameter. $C_o d$ is the concentration thickness at the nozzle exit, where d is the diameter of the nozzle and $C_o$ is the concentration thickness of the fluid exiting the nozzle.

Referring back to FIG. 1, the concentration of the stream 24 of fluid 18 within the volume of fluid 14 can be detected by mixing fluid 18 with a dye and scanning a beam of light 32 from a laser 26 such as an argon ion laser through the stream 24 of first fluid 18 with mirrors 28 and 30. The dye can be a fluorescent dye such as disodium fluorescein and the concentration of the dye within fluid 18 can be $2\times10^{-6}$ molar. However, other suitable dyes and concentrations can be used. Additionally, the laser induced fluorescence images can be recorded on photographic film and video taped for further analysis.

The beam of light 32 passes through a pinhole 42 and an interference filter 40 before reaching photodiode 34 which measures the intensity of the beam of light 32. The pinhole 42 is used to increase the spatial resolution of the measurements and to ensure that the photodiode does not get saturated at higher energy levels. Pinhole 42 can be for example, 100 micrometers in diameter. The interference filter 40 is employed to prevent any stray light from reaching the photodiode and for example, can have a bandwidth of 10 nanometers.

The intensity of the beam of light 32 sensed by photodiode 34 is converted into a voltage which is processed by computer 36 which converts the voltages to concentration thickness values. In addition, computer 36 controls the opening and closing of solenoid operated valves $V_1$, $V_2$ and $V_3$.

Absorption of the laser beam 32 by the dye within fluid 18 attenuates the laser intensity. The beam intensity, varies with the local concentration of fluid 18 and the optical path of beam 32 as follows:

$$\int_o^L KCds = \ln\left(\frac{I_o}{I}\right) \tag{1}$$

Where:

K=the dye absorption coefficient

C=local concentration of fluid 18

I=the laser beam intensity

L=the optical path $I_O$=the incoming beam intensity

Based on equation 1, the concentration thickness $<c\delta>$ of fluid 18 within fluid 14 is defined by:

$$<C\delta>_{(x,t)} = \int_o^\delta Cds = \frac{1}{K}\ln\left(\frac{I_o}{I}\right) \tag{2}$$

Figure 6:
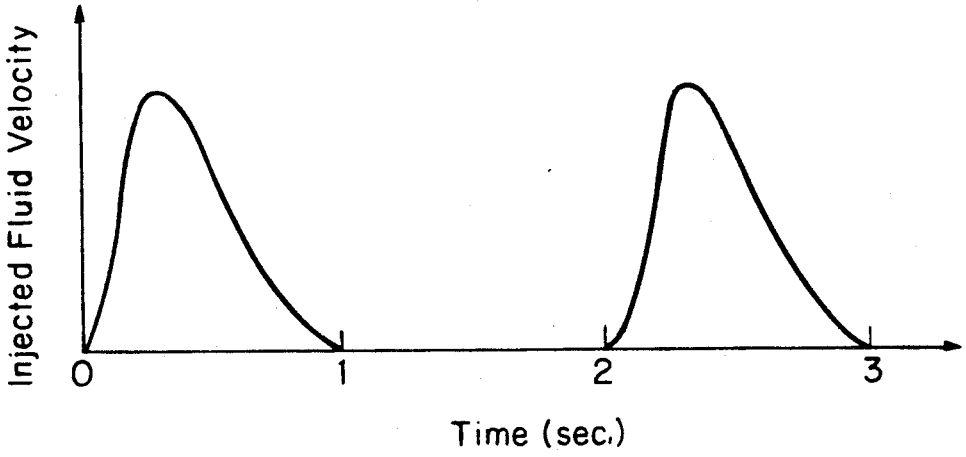
FIG. 6 is a graph of a velocity profile of injected first fluid velocity versus time.

Where:

$\delta$=the local jet diameter t=elapsed time,

FIG. 6 shows an example of a fluid velocity time history for repeated streams 24 of fluid 18 injected into fluid 14. The acceleration and deceleration of fluid 18 into fluid 14 is shown to last approximately 1 second with a 1 second dwell between pulses. Alternatively, other suitable time periods for pulses and dwells can be used.

Although the stream of fluid 18 is shown to be injected into the fluid 14 by gravity, first fluid 18 can be injected into fluid 14 with a pump or a cylinder. Additionally, if a pump is employed, fluid 18 can be injected into fluid 14 from the bottom or side of tank 12. Furthermore, valves $V_2$ and $V_3$ can be replaced with a single 3-way, 3-position valve. Also, fluids 14 and 18 can be liquids or gases as well as liquids or gases bearing sold particulates.

EQUIVALENTS

While this invention has been particularly shown and described with references to preferred embodiments thereof, it will be understood by those skilled in the art that various changes in form and details may be made therein without departing from the spirit and scope of the invention as defined by the appended claims.

What is claimed is:

1. A method of mixing fluids comprising:

introducing a stream of first fluid into a volume of second fluid through a nozzle, at an accelerating rate over a time period of at least 0.1 seconds; and decelerating to about zero the rate at which the stream of first fluid is introduced into the volume of second fluid over a time period of at least 0.1 seconds.

2. The method of claim 1 in which the steps of accelerating and decelerating the stream of first fluid into the volume of second fluid is repeated.

3. The method of claim 1 in which the acceleration of the stream of first fluid into the volume of second fluid forms a vortex of first fluid within the second fluid.

4. The method of claim 1 in which the deceleration of the stream of first fluid into the volume of second fluid produces mixing of the second fluid in a tail of first fluid extending from the vortex.

5. The method of claim 1 in which the stream of first fluid is accelerated over a time period of approximately ⅓ the time period over which the stream of first fluid is accelerated and decelerated.

6. The method of claim 5 in which the stream of first fluid is accelerated and decelerated over a time period of approximately 1 second.

7. The method of claim 6 in which the stream of first fluid is accelerated into the volume of second fluid over a time period ranging between approximately ¼ second to ½ second.

8. The method of claim 1 in which the stream of first fluid is accelerated and decelerated over a time period that is less than ten seconds.

9. The method of claim 1 in which the stream of first fluid is accelerated and decelerated over a time period greater than ½ second.

10. The method of claim 1 in which the first and second fluids are liquids.

11. The method of claim 1 in which the stream of first fluid is accelerated into the volume of second fluid by gravity.

12. The method of claim 1 in which the first and second fluids are fluids bearing solid particulates.

13. A method of mixing fluids comprising:

introducing a stream of first fluid into a volume of second fluid through a nozzle at an accelerating rate over a time period of at least 0.1 second, the accelerated stream of first fluid forming a vortex having a tail of first fluid within the volume of second fluid;

decelerating the rate at which the stream of first fluid is introduced into the volume of second fluid over a time period of at least 0.1 second, the decelerating stream of first fluid promoting mixing of the second fluid in the tail of first fluid extending from the vortex; and terminating the stream of first fluid.

14. The method of claim 13 in which the steps of accelerating, decelerating and terminating the stream of first fluid into the volume of second fluid is repeated.

15. The method of claim 13 in which the stream of first fluid is accelerated over a time period of approximately ⅓ the time period over which the stream of first fluid is accelerated, decelerated and terminated.

16. The method of claim 15 in which the stream of first fluid accelerated, decelerated and terminated over a time period of approximately 1 second.

17. The method of claim 16 in which the stream of first fluid is accelerated into the volume of second fluid over a time period ranging between ¼ seconds to ½ seconds.

18. The method of claim 13 in which the stream of first fluid is accelerated, decelerated and terminated over a time period that is less than ten seconds.

19. The method of claim 13 in which the stream of first fluid is accelerated, decelerated and terminated over a time period greater than ½ second.

20. The method of claim 13 in which the first and second fluids are liquids.

21. The method of claim 13 in which the stream of first fluid is accelerated into the volume of second fluid by gravity.

22. The method of claim 13 in which the first and second fluids are fluids bearing solid particulates.

* * * * *